US006000428A

United States Patent [19]

Berberat

[11] Patent Number: 6,000,428

[45] Date of Patent: Dec. 14, 1999

[54] WATER PUMP SYSTEM FOR A TRUCK

[76] Inventor: Charlie Berberat, Box 657, Roblin, Manitoba, Canada, R0C 1P0

[21] Appl. No.: 09/093,816

[22] Filed: Jun. 1, 1998

[51] Int. Cl.[6] ..... B67D 5/64

[52] U.S. Cl. ..... 137/615; 137/234.6; 137/236.1; 141/387

[58] Field of Search ..... 137/615, 152, 137/236.1, 234.6; 141/387, 388

[56] References Cited

U.S. PATENT DOCUMENTS

| | | | |
|---|---|---|---|
| 3,228,051 | 1/1966 | Voase et al. | 137/615 X |
| 3,381,711 | 5/1968 | Fye et al. | 137/615 |
| 4,774,979 | 10/1988 | McKeon et al. | 137/615 X |

*Primary Examiner*—Kevin Lee
*Attorney, Agent, or Firm*—Adrian D. Battison; Murray E. Thrift

[57] ABSTRACT

The present invention allows a person to collect water from a pond or slue without having to physically place the hose into the water. The present invention has a boom which extends from the side of a truck or any type of vehicle which allows the person to reach the water hole and stay relatively dry and clean. The boom has a hose which extends along the length of the boom and the hose slightly hangs over the end of the boom so that the hose can reach the top of the water. A common problem with putting a hose in the water hole is that the hose tends to collect debris from the bottom, the present invention is arranged so that the hose is placed on the top of the water only allowing water not debris into the hose for collection. The boom is adjustable vertically and horizontally so that the person can control the invention to maximize water collection. The boom is adjusted vertically by a pulley system which is arranged to lift the front end of the boom. The mount system allows the person to rotate the boom side to side.

6 Claims, 2 Drawing Sheets

WATER PUMP SYSTEM FOR A TRUCK

The present invention relates to a water pump for a truck.

BACKGROUND OF THE INVENTION

Conventionally a person would have to take a hose from a tank mounted on a truck and physically place the hose into a pond or slue. The present invention allows the person to put the hose into the pond or slue without having to physically go to the pond. The present invention lets the person guide the hose attached to a boom on the truck from a distance without getting wet or muddy. The present invention keeps the hose at the top of the water surface minimising the amount of mud or objects entering the hose. In the conventional method the hose is placed in the pond and the end of the hose would sink to the bottom and cause the pump to collect mud and other objects.

SUMMARY OF THE INVENTION

According to one aspect of the invention there is provided an apparatus for collecting water on a truck having a tank and a pump, the apparatus comprising;

a boom which extends horizontally from the truck;

a hose which is mounted along the length of the boom and hangs downwardly of the furthermost end of the boom so that the hose can pump the water;

a boom adjustment system which allows the boom to be raised upward and downwardly lowering the hose into the water;

a rotating boom mount member which allows the boom to move sideways for adjustment so that the hose can reach the water and for mounting the boom on the truck;

Preferably the boom is mounted on the rotating boom mount member by a hinge which allows the boom to be adjusted vertically upward and downward by the boom adjustment system.

It is preferred that the boom has an extended boom portion which extends horizontally parallel from the furthermost end of the boom has is mounted on a second hinge which allows the extend boom portion to be adjusted sideways;

Preferably the boom adjustment system has a pulley system including a winch and at least one pulley which can be operated to raise and lower the boom;

a second pulley being free wheeled and mounted on the rotating boom mount member so that when the handle of the first pulley is turned a cable is tightened and loosened;

the cable being attached to the first pulley and is supported by the second and fixed to a cable ring located on the furthermost end of the first boom portion and when the cable is tightened the boom is raised and when the cable is loosened the boom is lowered.

Preferably the hose is inserted through a plurality of hose support members which are mounted on the bottom side of the boom.

Preferably a boom support member is a rod which is arranged to support the boom.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
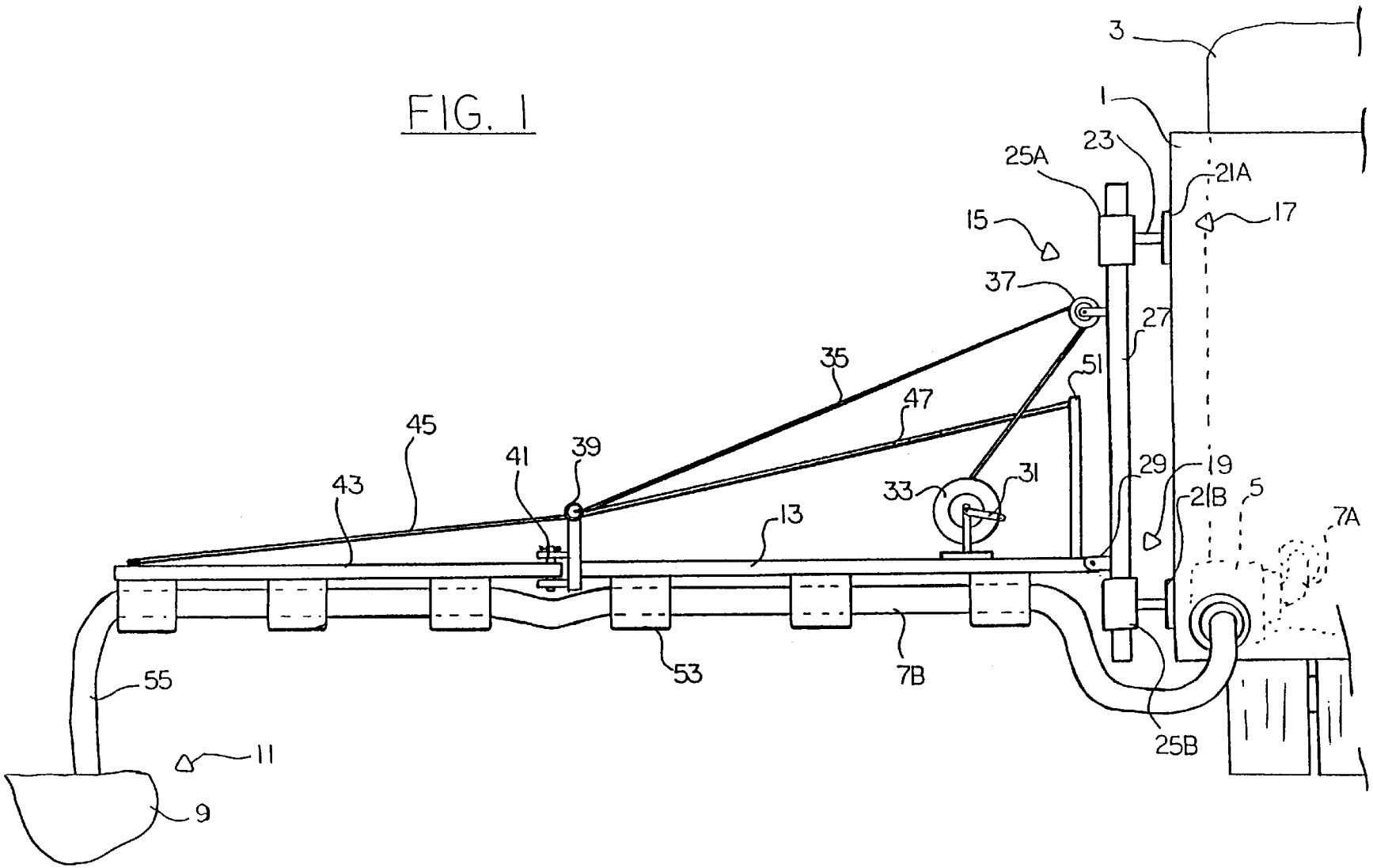
FIG. 1 is side elevational view of the present invention.
Figure 2:
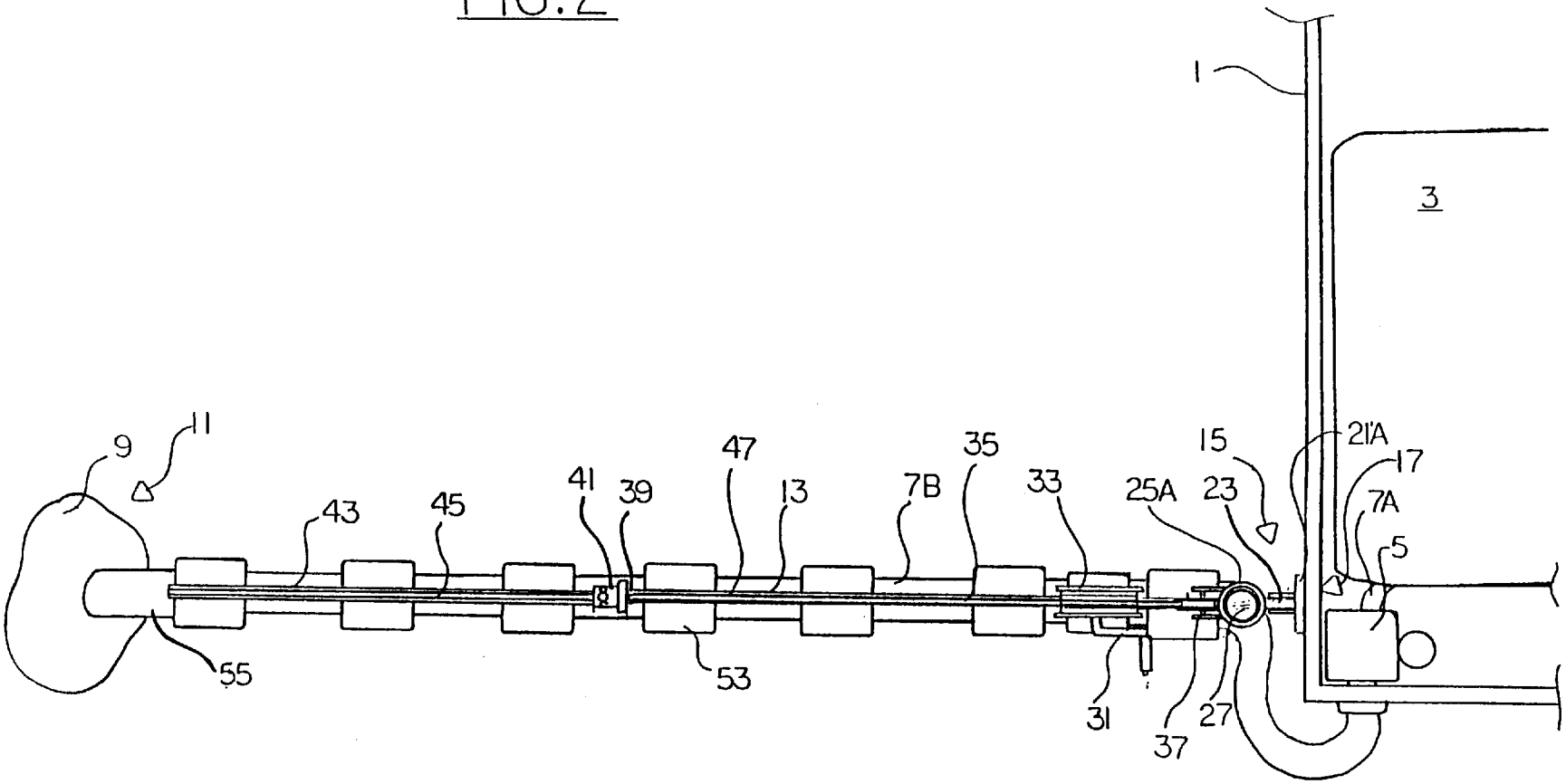
FIG. 2 is top plan view of the present invention.

A truck 1 has a water tank 3 located in the rear portion. The water tank 3 is attached to a pump 5 by a hose 7A. The pump 5 is arranged so that it pumps water 9 through a second hose 7B out of a slue or pond 11 into the tank 3.

The hose 7B is mounted on a boom 13 which is mounted on the side of the truck 1. The boom 13 extends horizontally outward to the pond 11. The boom 13 is mounted on the truck by a rotating boom mount assembly 15. The rotating boom mount assembly consists of a first mounting bracket 17 and a second mounting bracket 19. The mounting brackets 17 and 19 have a mount portion 21A and 21B which has a horizontal extension 23 extending from the center of the mount portions 21A and 21B. The mount portions 21A and 21B consist of a flat material with a flat side on the truck 1 and the second flat side facing outwardly from the truck in which the horizontal extension 23 is mounted. At the outermost end of the horizontal extension 23 is a hollow vertical tube 25A and 25B which has a vertical pipe 27 inserted through. The vertical pipe 27 passes through the vertical tube 25A of the mount portion 21A and extends vertically downwardly to the vertical tube 25B of the mount portion 21B. The boom mount assembly 15 is arranged to work as a hinge for the boom 13.

Located directly above the vertical tube 25B is a hinge 29 which is attached to the boom 13. The hinge 29 allows the boom 13 to be vertically adjusted by the operator. The operator adjusts the boom vertically by turning the handle 31 of the winch 33. The winch 33 is mounted on the boom 13 and has a cable 35 extending vertically to a second pulley 37. The second pulley 37 is mounted on the vertical pipe 27 below the vertical tube 25A. The cable 35 then extends forwardly to a cable ring 39. To raise and lower the boom 13 the operator turns the handle 31 in the appropriate direction. The cable ring 39 is located at the end 13A of the boom 13.

Mounted on the end 13A of the boom 13 is a second hinge 41 in which a boom extension 43 is attached. The boom extension 43 extends horizontally parallel off the end 13A of the boom 13. The second hinge 41 allows the boom extension 43 to be adjusted horizontally side to side. The boom extension 43 is supported by a rod 45 which is mounted on the cable ring 39 and extends to the furthermost end 43A of the boom extension 43.

A second rod 47 is arranged to support the boom 13. The second rod 47 is mounted on the top end of a bar 51 which is mounted on the boom 13 and extends vertically. The bar 51 is mounted on the boom 13 before the pulley 33 and after hinge 29. The second rod 47 extends horizontally to mount on the cable ring 39.

The hose 7B is inserted through a plurality of hose mounts 53 which a spaced along the boom 13 and the boom extension 43. The hose mounts 53 are hollow tubes which are of appropriate size so that the hose 7B can be inserted through. The hose 7B runs along the length of the boom 13 and the boom extension 43 to the furthermost end of the boom extension 43 and is slightly longer than the boom 13 and the boom extension 43 so that a hang portion 55 on the hose 7B can extend downwardly to the water 9 in a pond or slue 11. The pump 5 pulls the water 9 through the hose 7B along the boom 13 to the first hose 7A and into the tank 3 in the truck 1.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

I claim:

1. An apparatus for collecting water comprising:

a truck having a tank mounted thereon and a pump for pumping water into the tank for transport on the truck;

a boom mounted on the truck so as to extend generally horizontally from the truck;

a hose having a first end connected to the pump for supplying water thereto and a second end having an open mouth for suspending into a water supply, a length of the hose being mounted along the length of the boom so as to be supported thereby and such that the second end hangs downwardly of an outermost end of the boom;

a boom adjustment system which allows the outermost end of the boom to be raised and lowered, the second end being located at a spacing relative to the outermost end of the boom such that the open mouth is suspended below the outermost end such that raising and lowering the outermost end effects raising and lowering of the open mouth thus adjusting the height of the open mouth such that it enters into the surface of the water;

and a pivotal boom mount member mounting an inner end of the boom on the truck which allows the outermost end of the boom to pivot sideways for adjustment so that the open mouth of the hose can reach the water.

2. The apparatus for collecting water on a truck according to claim 1 wherein the boom is mounted on the rotating boom mount member by a hinge which allows the boom to be adjusted vertically upward and downward by the boom adjustment system.

3. The apparatus for collecting water on a truck according to claim 1 wherein the boom has an extended boom portion which extends horizontally parallel from the furthermost end of the boom has is mounted on a second hinge which allows the extend boom portion to be adjusted sideways.

4. The apparatus for collecting water on a truck according to claim 1 wherein the boom adjustment system has a pulley system including a winch and at least one pulley which can be operated to raise and lower the boom;

a second pulley being free wheeled and mounted on the rotating boom mount member so that when a handle of the first pulley is turned in a first direction a cable is tightened and when the first pulley is turned in a second direction the cable is loosened;

the cable being attached to the first pulley and is supported by the second pulley and fixed to a cable ring located on an outer end of the first boom portion and when the cable is tightened the boom is raised and when the cable is loosened the boom is lowered.

5. The apparatus for collecting water on a truck according to claim 1 wherein the hose is inserted through a plurality of hose support members which are mounted on the bottom side of the boom.

6. The apparatus for collecting water on a truck according to claim 1 wherein a boom support member is a rod which is arranged to support the boom.

* * * * *